US007308813B2

(12) United States Patent
Koike

(10) Patent No.: US 7,308,813 B2
(45) Date of Patent: Dec. 18, 2007

(54) CLUTCH HOUSING AND METHOD FOR MANUFACTURING THE SAME

(75) Inventor: Yasuhito Koike, Fukuroi (JP)

(73) Assignee: NSK-Warner K.K., Tokyo (JP)

( * ) Notice: Subject to any disclaimer, the term of this patent is extended or adjusted under 35 U.S.C. 154(b) by 0 days.

(21) Appl. No.: 11/175,187

(22) Filed: Jul. 7, 2005

(65) Prior Publication Data

US 2006/0005595 A1 Jan. 12, 2006

(30) Foreign Application Priority Data

Jul. 8, 2004 (JP) ..... 2004-202108
Aug. 17, 2004 (JP) ..... 2004-237040

(51) Int. Cl.
*B21B 27/06* (2006.01)
*B21D 22/14* (2006.01)

(52) U.S. Cl. ..... 72/69; 72/68; 72/342.2; 72/342.5; 148/644; 148/654

(58) Field of Classification Search ..... 72/68, 72/69, 82, 83, 84, 85, 342.5, 342.6, 342.74, 72/342.2; 148/639, 644, 649, 654, 902
See application file for complete search history.

(56) References Cited

U.S. PATENT DOCUMENTS 2,193,891 A * 3/1940 Talbot-Crosbie et al. .. 72/342.2
4,879,793 A * 11/1989 Stuecker et al. ..... 29/889
5,384,949 A * 1/1995 Wodrich et al. ..... 29/557
5,836,431 A * 11/1998 Jaekel ..... 192/70.2
6,127,044 A * 10/2000 Yamamoto et al. ..... 428/603
6,488,788 B2 * 12/2002 Ito et al. ..... 148/330
6,539,765 B2 * 4/2003 Gates ..... 72/69
6,729,170 B1 * 5/2004 Sakaguchi et al. ..... 72/69

FOREIGN PATENT DOCUMENTS

JP 3-189044 8/1991

* cited by examiner

*Primary Examiner*—Ed Tolan
(74) *Attorney, Agent, or Firm*—Miles & Stockbridge P.C.

(57) ABSTRACT

A method of manufacturing a clutch housing having a boss portion and a drum portion integrally provided with the boss portion, is characterized by steps of integrally forming the boss portion and the drum portion by hot forging, and forced-cooling at least a portion of the boss portion, continuous to the integrally forming step.

5 Claims, 5 Drawing Sheets

CLUTCH HOUSING AND METHOD FOR MANUFACTURING THE SAME

BACKGROUND OF THE INVENTION

Field of the Invention

The present invention relates to a method of manufacturing a clutch housing used for a vehicle transmission or the like.

Description of the Related Art

In general, there has been used a drum type clutch housing for an automatic transmission (AT) for an automobile or the like. A clutch housing as mentioned above has been manufactured by cold forging with a predetermined degree of accuracy and in predetermined dimensions.

In general, the clutch housing is composed of a center boss portion, and a drum portion joined to the former. The boss portion and the drum portion are joined to each other, firmly by welding and calking. As shown in FIGS. 10 and 11, a housing 10 is composed of a boss member 11 and a drum portion 12 which are joined to each other by electron beam welding. It is noted here that the boss member 11 is made of a material which requires refining in view of a required function and a required strength. Further, the drum portion 12 is made of a material having an appropriately selected degree of harness in view of its plastic workability, but has not to have a high degree of hardness. FIG. 10 shows the boss portion 11 which is extended inward of the housing 10, but FIG. 11 shows the boss portion is extended outward from the housing 10.

Further, there has been known a manufacturing method in which a clutch housing is previously by hot forging in a product-like form, and thereafter, and is then subjected to cold forging so as to ensure a desired degree of accuracy (Refer to, for example, Japanese Patent Laid-Open No. H03-189044). In this example, the boss portion and the drum portion are integrally provided with each other. In a method of manufacturing an integral type clutch drum with a hub, which is composed of a boss portion and a drum portion tooth-formed by forging, the boss portion which requires a predetermined strength is heat-treated in order to obtain a predetermined degree of hardness.

The clutch housings as stated above have caused the following problems:

Conventional integral type clutch housings have been refined in its entirely including the drum portion, and accordingly, there has been caused such a problem that the refining deteriorates the workability.

Further, since the hardness of the drum portion is increased, similar to the boss portion, the hardness of the drum portion is too hard to carry out plastic tooth-formation, resulting in occurrence of deficiencies such as material clacking during working, a shortened serviced life of a working jig or vibration of working machinery due to strong plastic deformation and the like. Further, since the boss portion has to be heat-treated after the plastic tooth formation, there has been raised such a disadvantage that deformation is caused after plastic working of the drum portion, and so forth.

SUMMARY OF THE INVENTION

Accordingly, an object of the present invention is to provide a method of manufacturing a clutch housing on a mass production base, which can eliminate the necessity of refining in a manufacture of an integral form type clutch housing so as to enhance the workability, and as well, an integrally formed blank is used so as to enhance both hardness and strength.

To the end, according to the present invention, there is provided a method of manufacturing a clutch housing having a boss portion and a drum portion integrally provided with the boss portion, the method comprising the steps of:

integrally forming the boss portion and the drum portion by hot forging, and forced-cooling at least a portion of the boss portion, continuous to the integrally forming step.

Further, according to the present invention, there is provided a clutch housing having a boss portion and a drum portion integrally with the boss portion, wherein the clutch housing is manufactured by a manufacturing method comprising the steps of integrally forming the boss portion and the drum portion by hot forging, and forced-cooling at least a portion of the boss portion, continuous to the integrally forming step.

The present invention offers the following technical effects and advantages:

Since no refining step is carried out after forging and a required degree of harness is obtained in a necessary portion, the degree of hardness of a portion which is subjected to a forming process is adjusted to enhance the workability. Moreover, the cost performance can be enhanced. In view of the above-mentioned features, a clutch housing can be manufactured on a mass production base.

In order to obtain both required degree of hardness for the boss portion and required degree of harness for plastic working of the drum portion, waste heat from the hot forging can be used so as to simultaneously carry out heat treatment for obtaining a required degree of hardness in the boss portion and air radiation cooling (normalizing) for obtaining a degree of hardness which is required for plastic working of the drum portion, thereby it is possible to enhance the workability of forming splines and to continuously manufacture an integral type clutch housing with a hub at an inexpensive cost.

During plastic working of an integral forged product with no joint, the necessity of a refining step is eliminated so as to enhance the workability, only a portion which requires a high degree of harness is dipped in water so as to obtain both surface hardness and core hardness, thereby it is possible to set up hardness and strength corresponding to the heat-treatment.

DESCRIPTION OF THE PREFERRED EMBODIMENTS

Figure 1:
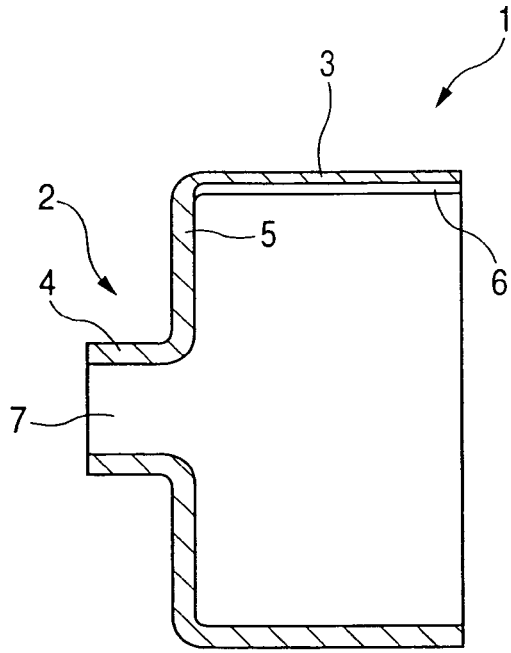
FIG. 1 is an axially sectional view illustrating a clutch housing in one embodiment of the present invention.

Detailed explanation will be hereinbelow made of several embodiments of the present invention with reference to the accompanying drawings in which like reference numerals are used to denote like parts throughout the drawings. Further, it is noted that the embodiments which will be explained hereinbelow are mere examples of the present invention, that is, the present invention should not be limited to these embodiments.

FIG. 1 is an axially sectional view which shows a clutch housing in an embodiment of the present invention. The clutch housing 1 which is manufactured by a method according to the present invention is composed of a substantially cylindrical drum portion 3 and a boss portion 2 integrally provided with the drum portion 3. The boss portion 2 is composed of a disc portion 5 integrally provided with the drum portion 2, and a shaft portion 4 integrally provided with the disc portion 5 at the center thereof, and fitted therein with a shaft which is not shown and serving as a hub.

The drum portion 3 is formed at its inner peripheral portion with splines 6. The inner peripheral portion of the drum portion 3 is adapted to accommodate therein a friction engaging device (which is not shown) supported by a shaft (which is not shown) which is fitted in a through hole 7 formed in the shaft portion 4, and a friction plate which is not shown is engaged with the splines 6 so as to be axially displaceable. A boss portion 2 is extended in a direction opposite to the drum portion 3. That is, it is extended outward from the drum portion 3.

The clutch housing 1 is manufactured as follows. At first, a workpiece (which is not shown) made of steel which is appropriate for plastic working, is formed by hot forging or cold forging, so as to obtain the clutch housing 1 shown in FIG. 1.

Thereafter, only a portion thereof which requires a high degree of hardness is dipped in water without refining, just after the forging. Thus, not only surface harness but also core harness can be obtained so as to set up both hardness and strength corresponding to the heat-treatment. Only the boss portion 2 has to be dipped in water, that is, it is subjected to water quenching, but the drum portion 3 has not to be subjected to water quenching.

The water quenching step or forced-cooling step for the boss portion 3 will be explained with reference to FIG. 3 which is a view for explaining the forced-cooling step for the boss portion and the air-radiation cooling step for the drum portion. Continuously just after the hot forging of a blank which is not shown, the boss portion is subjected to the water quenching by forced-cooling. The clutch housing 1 is gradually dipped into water 21 reserved in a container 20 with the shaft portion 4 being directed downward. Since the dipping is carried out, continuous from the hot forging, the boss portion 2 holds sufficient waste heat. Thus, forced-cooling can be made for the boss portion by dipping the same in the water. Thus, sufficient hardness can be ensured.

In the above-mentioned forced-cooling step, the clutch housing 1 is held so as to prevent the drum portion 3 from being submerged into the water in order to carry out radiation cooling in the air. That is, the forced-cooling of the boss portion 2 and the air radiation cooling of the drum portion 3 are simultaneously effected. In the case of the configuration shown in FIG. 2, that is, in the case of the clutch housing having the boss portion 2 which is extended inward of the drum portion 3, water is jetted only to the boss portion 2 in order to carry out the forced-cooling.

Of the boss portion 2, only the shaft portion 4 which requires in particular a high degree of hardness may be subjected to water quenching but the disc portion 5 may be prevented from being subjected to water quenching. After the portion which requires a high degree of hardness is subjected to water quenching, the clutch housing 1 is subjected to plastic working by flow forming. The present invention is implemented in order to obtain a required degree of harness for the boss portion and a required degree of hardness for plastic working of the drum portion.

During the flow forming step, the shape of the drum portion 2 is set to be in order, and the splines 6 and the like are formed. At this stage, since no water quenching for applying a required degree of harness to the drum portion has yet been made, there can be prevented from such a risk that cracking or the like occurs so as to remarkably deteriorate the workability during the plastic working through the flow forming step. That is, by applying a high degree of hardness for only a required part, the portion to which the flow forming step is subjected in order to adjust the hardness of the drum portion 3 is adjusted, thereby it is possible to enhance the workability.

Figure 2:
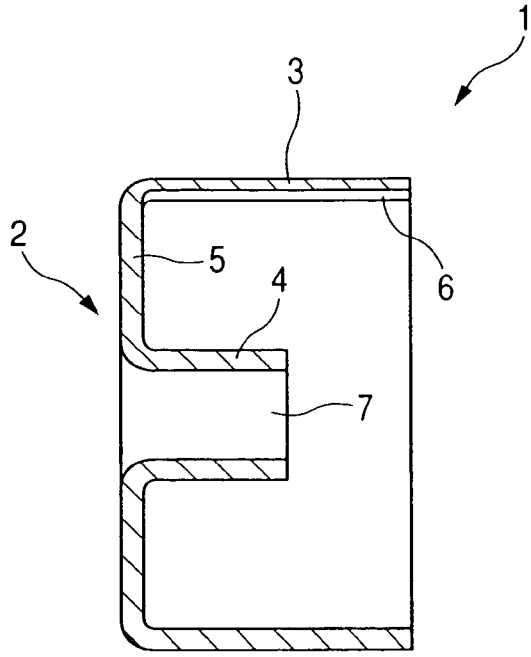
FIG. 2 is an axial sectional view illustrating a clutch housing in another embodiment of the present invention.

Next, referring to FIG. 2, explanation will be made of another embodiment of the present invention. The configuration shown in FIG. 2 is substantially the same as that explained with reference to FIG. 1, except that the shaft portion 4 of the boss portion 2 is extended inward of the drum portion 3.

With the use of the flow forming step which is one kind of plastic working steps, the splines can be integrally formed at the beginning and at a low cost, and since the splines are cold-formed, the strength thereof can be enhanced. Further, due to the integral structure, no deformation which would be caused by welding occurs, thereby it is possible to obtain several advantages such as ensuring of a high degree of accuracy.

Figure 4:
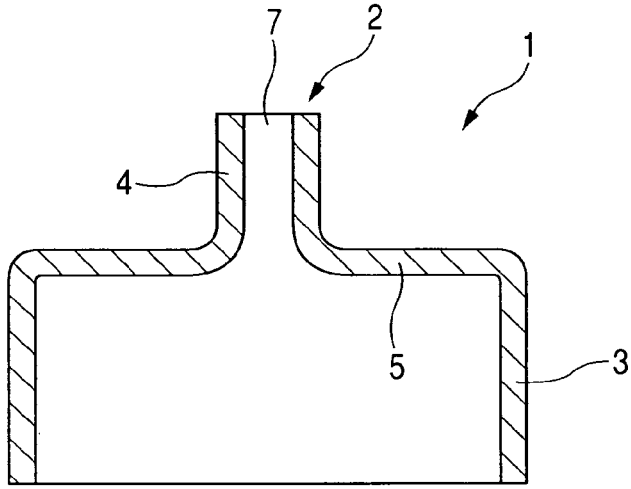
FIG. 4 is an axially sectional view illustrating an example of a clutch housing to which the present invention can be applied.
Figure 5:
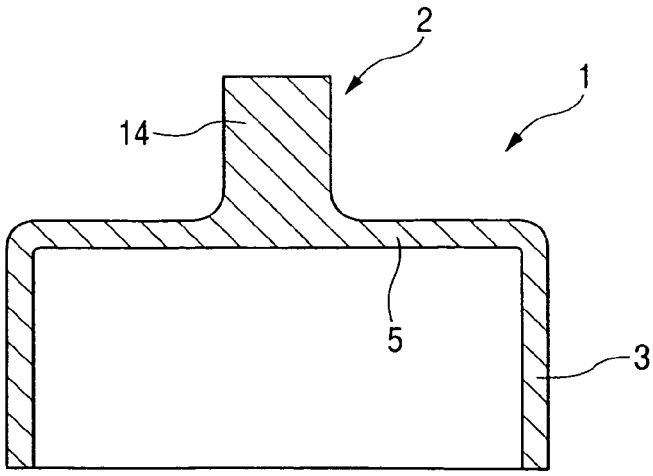
FIG. 5 is an axially sectional view illustrating an example of a clutch housing, similar to the clutch housing shown in FIG. 4, except that the boss portion is solid.

Explanation will be hereinbelow made of several configurations of clutch housings to which the present invention can be applied, with reference to FIGS. 4 to 9. FIG. 4 is an axially sectional view illustrating an example of a clutch housing to which the present invention can be applied and which has the same basic configuration as that shown in FIG. 1. FIG. 5 is an axially sectional view illustrating an example of the clutch housing 1 in which the boss portion 2 is solid. As clearly understood from FIG. 5, no through-hole 7 is formed in the boss portion 2.

As to both clutch housings 1 shown in FIGS. 4 and 5, the shaft portion 4 of the boss portion 2 or the solid shaft 4 of the boss portion 2 can be dipped in water so as to carry out water quenching. In the case of the boss portion 2 having the solid shaft portion 4, which is shown in FIG. 5, the dipping time is set to be longer than that for the boss portion having the through hole as shown in FIG. 4.

Figure 6:
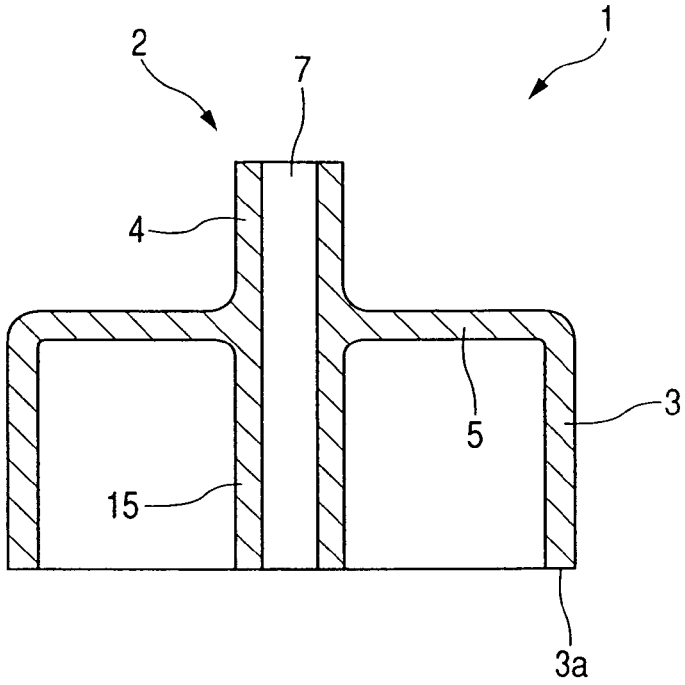
FIG. 6 is an axially sectional view illustrating an example of a clutch housing to which the present invention can be applied.
Figure 7:
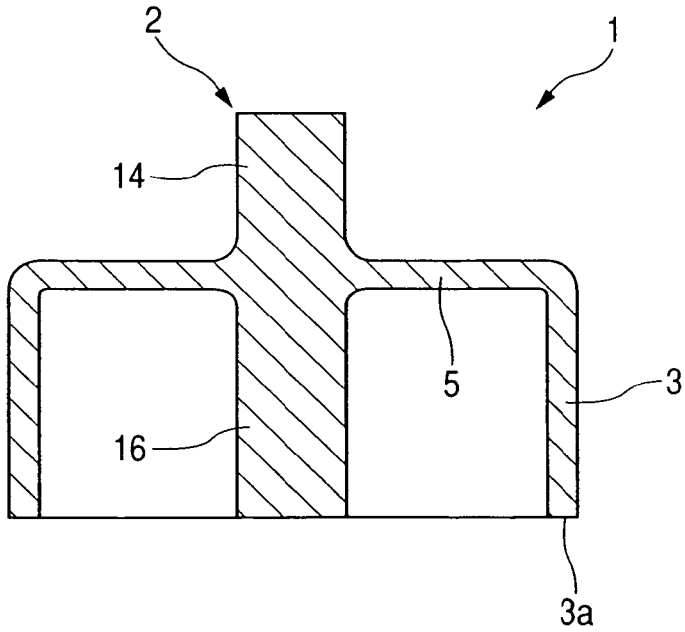
FIG. 7 is an axially sectional view an example of a clutch housing similar to the clutch housing shown in FIG. 6, except that the boss portion is solid.

FIG. 6 is an axially sectional view illustrating an example of a clutch housing to which the present invention can be applied, and FIG. 7 is an axially sectional view illustrating an example of a clutch housing having the same configuration as that shown in FIG. 4, except that the boss portion is solid. As clearly understood from FIG. 7, no through hole 7 is formed in the boss portion 2.

Referring to FIG. 6, the boss portion 2 has a shaft portion 4 extended outward from the clutch housing 1 and a shaft portion 15 extended inward of the clutch housing, which are integrally provided with each other. The shaft portion 15 is extended up to a position which is flush with an axially open end 3*a* of the outer peripheral portion of the drum portion 3. Further, in the example shown in FIG. 7, the boss portion 2 has a solid shaft portion 4 extended outward from the clutch housing 1 and a solid shaft portion 16 extended inward of the clutch housing 1, which are integrally provided with each other. The shaft portion 16 is extended up to a position which is flush with an open end 3*a* of the outer peripheral portion of the drum portion 3.

Figure 3:
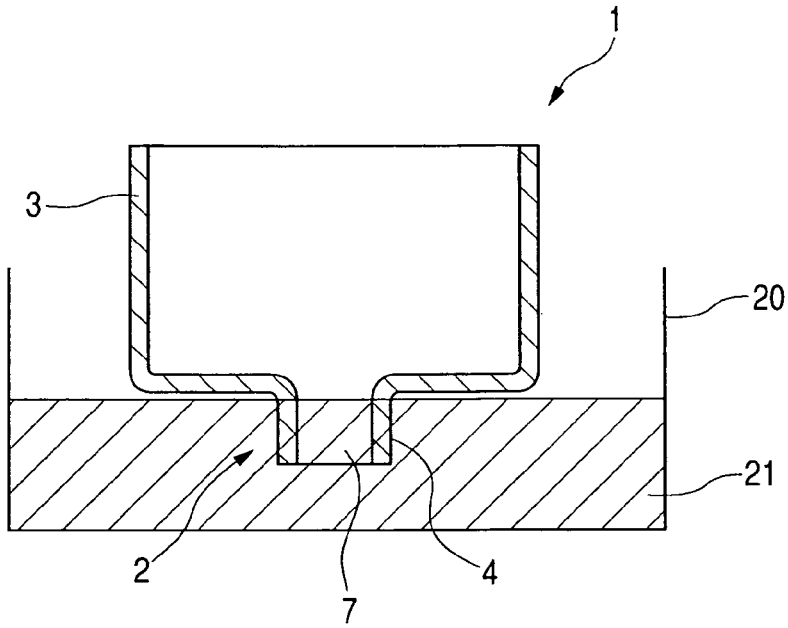
FIG. 3 is a view for explaining a step of forced-cooling a boss portion and a step of air-radiation cooling a drum portion.

Either of the clutch housings 1 shown in FIGS. 6 and 7 can be dipped into the water in such a way as shown in FIG. 3 so as to carry out water quenching. However, the shaft portion 15 (FIG. 6) or the shaft portion 16 (FIG. 7) can be quenched by a step of jetting water or the like. In the case of the shaft portion 16 which is solid as shown in FIG. 7, the dipping time is set to be longer than the boss portion shown in FIG. 4, which is formed therein with the through hole.

Figure 8:
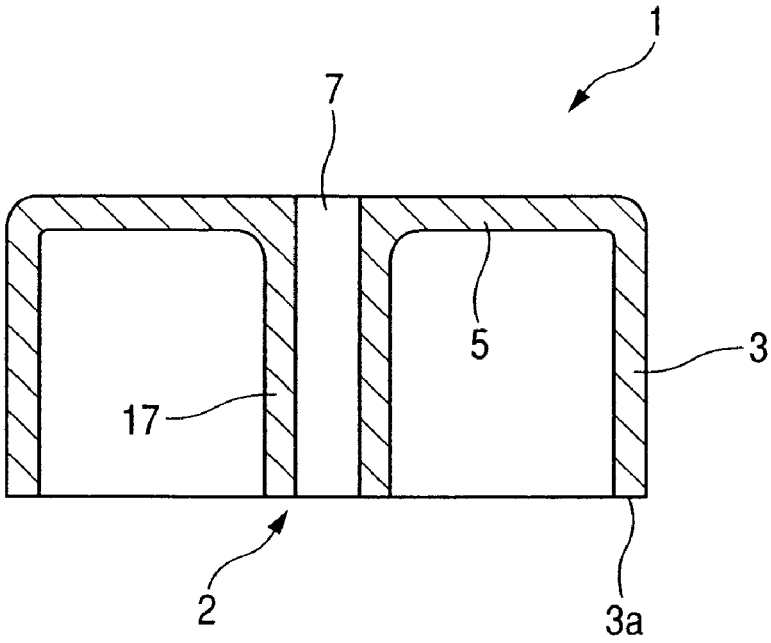
FIG. 8 is an axially sectional view illustrating an example of a clutch housing to which the present invention can be applied.
Figure 9:
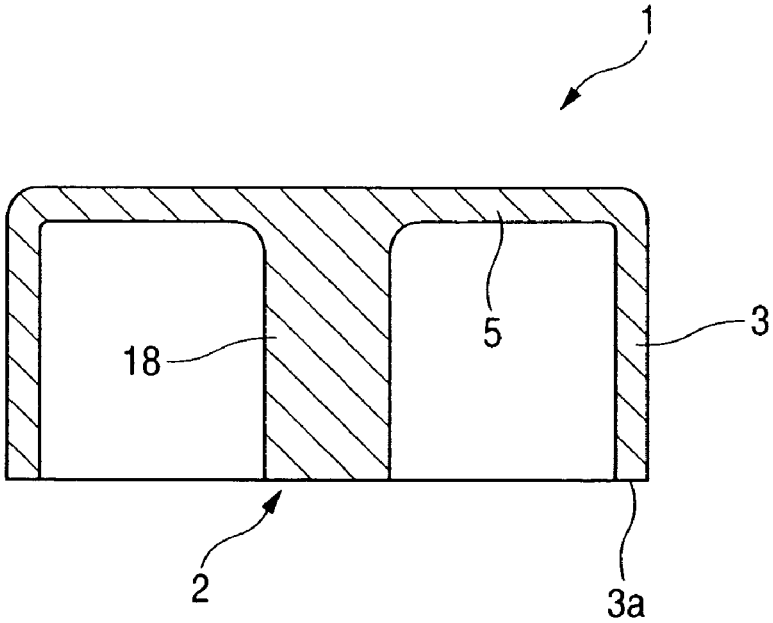
FIG. 9 is an axially sectional view illustrating an example of a clutch housing similar to the clutch housing shown in FIG. 8, except that the boss portion is solid.
Figure 10:
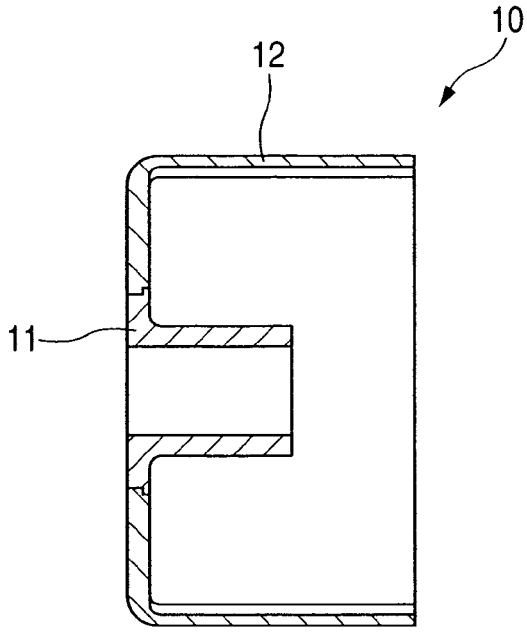
FIG. 10 is an axially sectional view illustrating a conventional clutch housing.
Figure 11:
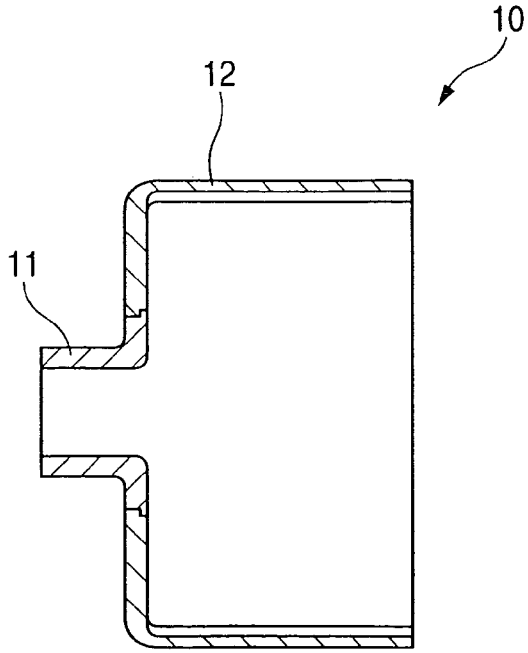
FIG. 11 is an axially sectional view illustrating a conventional clutch housing in another example.

FIG. 8 is an axially sectional view illustrating an example of a clutch housing to which the present invention can be applied, and FIG. 9 is an axially sectional view illustrating an example of a clutch housing having the same configuration as that shown in FIG. 9, except that the boss portion 2 is solid. As clearly understood from FIG. 9, no through-hole 7 is formed in the boss portion 2.

Referring to FIG. 8, the clutch housing 1 has only a shaft portion 17 which is extended inward of the clutch housing 1. This shaft portion 17 is axially extended up to a position which is flush with an axially open end 3*a* of the outer peripheral portion of the drum portion 3. Further, in the configuration shown in FIG. 9, the clutch housing 1 has only a solid shaft portion 18 which is extended inward of the clutch housing 1. The shaft portion 18 is axially extended up to a position which is flush with an axially open end of the outer peripheral portion of the drum portion 3.

As to both clutch housings 1 shown in FIGS. 8 and 9, the shaft portion 17 of the boss portion 2 and the solid shaft portion 18 thereof can be quenched by a step of jetting water or the like. The examples shown in FIGS. 4 to 9, no splines have yet been formed at the inner periphery of the clutch housing 1. Further, the shaft portion 15, 16, 17 and 18 which are each extended inward of the clutch housing 1 can be quenched by dipping water.

With the use of the flow forming step as one kind of plastic working steps, the splines can be formed at the beginning in the clutch housing as an integral product, and since the splines are cold-formed, the strength can be enhanced. Further, due to the integral structure, no deformation which would be caused by welding occurs, thereby it is possible to obtain several advantages including ensuring of a high degree of accuracy.

As stated above, according to the present invention, a blank is hot-forged so as to integrally form the boss portion and the drum portion, and thereafter, both air-radiation cooling and forced-cooling are simultaneously carried out. Then, the splines are formed in the drum portion, and finally, finish cutting is carried out. With the use of the heat-treatment as stated above, it is possible to provide a continuous manufacturing process at a low cost.

The clutch housing which is formed by the manufacturing method according to the present invention, can be used for an automatic transmission, and a multi-disc type frictionally engaging device which is incorporated therein may be either of wet type or a dry type.

This application claims priority from Japanese Patent Application No. 2004-202108 filed on Jul. 8, 2004 and 2004-237040 filed on Aug. 17, 2004, which is hereby incorporated by reference herein.

What is claimed is:

1. A method of manufacturing a clutch housing having a boss portion and a drum portion integrally provided with the boss portion, said method comprising the steps of:

integrally forming the boss portion and the drum portion by hot forging, and forced-cooling at least a portion of the boss portion, continuous to the integrally forming step, wherein after the forced-cooling step, a step of forming splines in the inner peripheral portion of the drum portion by flow forming, and a step of making the clutch housing into a substantially finished product are included.

2. A method of manufacturing a clutch housing according to claim 1, wherein the boss portion is dipped in water, and simultaneously, the drum portion is subjected to air-radiation cooling during the forced-cooling step.

3. A method of manufacturing a clutch housing according to claim 1, wherein the boss portion is sprayed with water, and simultaneously, the drum portion is subjected to air-radiation cooling during the forced-cooling step.

4. A method of manufacturing a clutch housing having a boss portion and a drum portion integrally provided with the boss portion, said method comprising the steps of:

integrally forming the boss portion and the drum portion by hot forging, and continuous with the integrally forming step, force-cooling only the boss portion or a part thereof, wherein the boss portion is sprayed with water, and simultaneously, the drum portion is subjected to air-radiation cooling during the forced-cooling step, and wherein after the forced-cooling step, a step of forming splines in the inner peripheral portion of the drum portion by flow forming, and a step of making the clutch housing into a substantially finished product are included.

5. A method of manufacturing a clutch housing having a boss portion and a drum portion integrally provided with the boss portion, said method comprising the steps of:

integrally forming the boss portion and the drum portion by hot forging, and continuous with the integrally forming step, force-cooling only the boss portion or a part thereof, wherein the boss portion is dipped in water, and simultaneously, the drum portion is subjected to air-radiation cooling during the forcedcooling step, and wherein after the forced-cooling step, a step of forming splines in the inner peripheral portion of the drum portion by flow forming, and a step of making the clutch housing into a substantially finished product are included.

* * * * *